US008127393B1

(12) United States Patent
Dockter

(10) Patent No.: US 8,127,393 B1
(45) Date of Patent: Mar. 6, 2012

(54) INTERCHANGEABLE RETRACTING HAIR BRUSH

(76) Inventor: Gregory S. Dockter, Cottage Grove, WI (US)

( * ) Notice: Subject to any disclaimer, the term of this patent is extended or adjusted under 35 U.S.C. 154(b) by 1037 days.

(21) Appl. No.: 11/970,775

(22) Filed: Jan. 8, 2008

(51) Int. Cl.
*A45D 24/16* (2006.01)

(52) U.S. Cl. ..... 15/184; 15/201

(58) Field of Classification Search ..... 15/184, 15/191.1, 201; 132/121, 123, 151
See application file for complete search history.

(56) References Cited

U.S. PATENT DOCUMENTS 2,014,616 A * 9/1935 Fess ..... 15/203
D272,662 S 2/1984 Smal
5,333,343 A * 8/1994 Nichols et al. ..... 15/106
D401,419 S 11/1998 Hartmann et al.
6,851,431 B2 * 2/2005 Mayeri ..... 132/121
7,653,960 B2 * 2/2010 Lee ..... 15/184

FOREIGN PATENT DOCUMENTS

DE 3602052 A * 7/1987

* cited by examiner

*Primary Examiner* — Shay Karls
(74) *Attorney, Agent, or Firm* — Donald J. Ersler

(57) ABSTRACT

An interchangeable retractable hair brush includes a retracting brush element and a brush case. The retracting brush element includes a brush base and a brush body. A spring loaded detent pin is retained in the brush base. A notch is preferably formed in the brush base for brush bodies with a round cross section. The brush body includes a plurality of brush projections. An inner perimeter of the brush case is sized to slidably receive the brush base. First and second location openings are formed through a wall of the brush case to receive the spring detent pin for retaining the brush body in retracted and extended positions. A lengthwise projection extends from the inner perimeter of the brush case. The lengthwise projection is sized to be received by the notch. The retracting brush element and the brush case preferably come in different styles, shapes and colors.

14 Claims, 2 Drawing Sheets

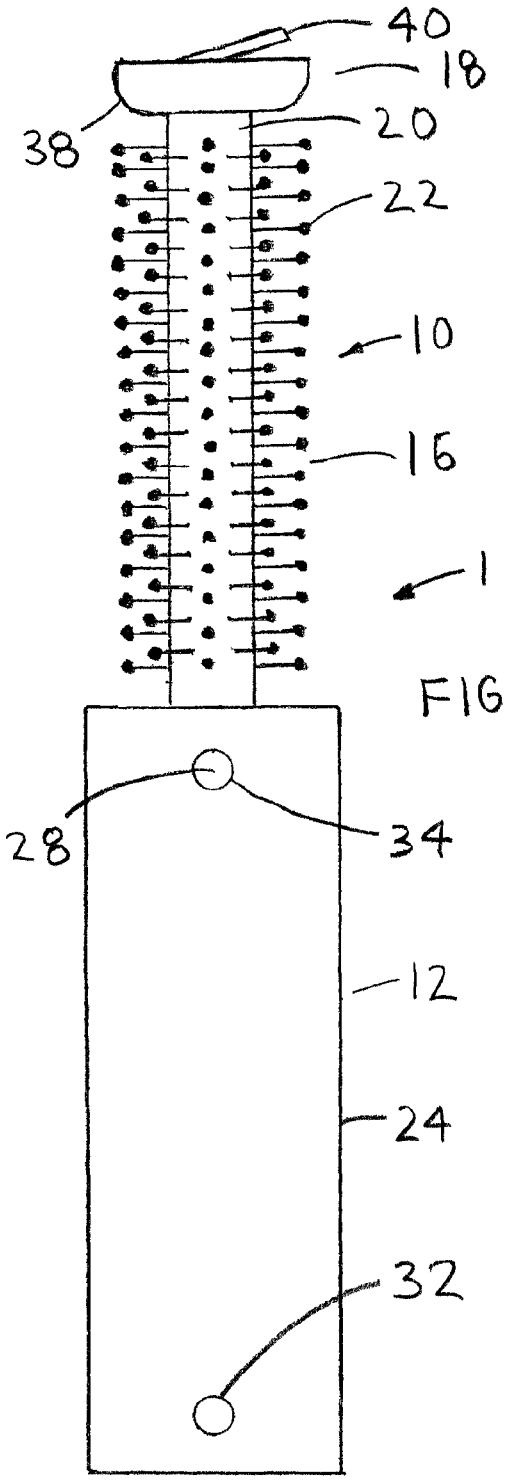
FIG. 1
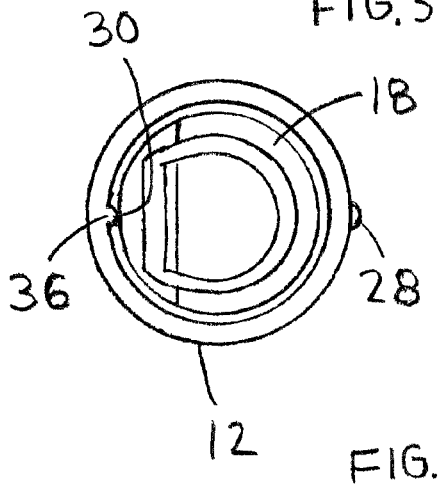
FIG. 3
FIG. 2
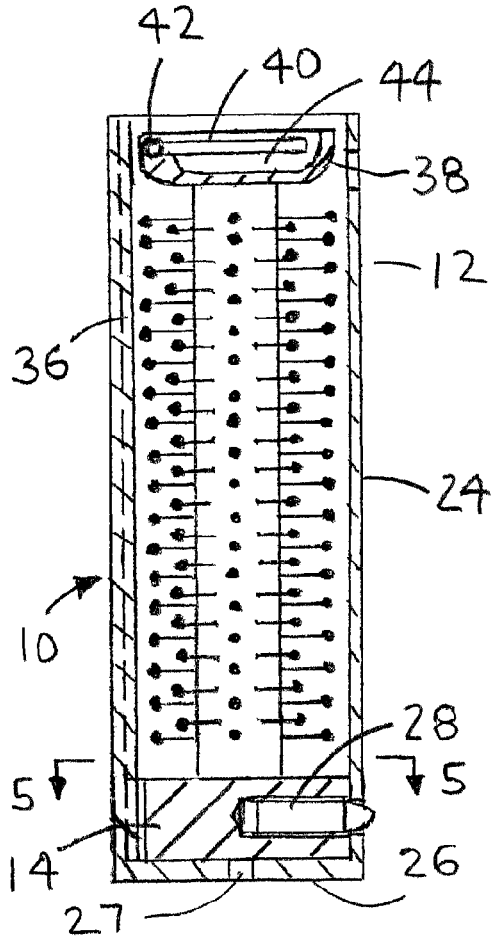

INTERCHANGEABLE RETRACTING HAIR BRUSH

BACKGROUND OF THE INVENTION

1. Field of the Invention

The present invention relates generally to retractable hair brushes and more specifically to an interchangeable retractable hair brush, which includes an interchangeable retracting brush element and brush case.

2. Discussion of the Prior Art

U.S. Pat. No. D272,662 to Smal discloses a retractable heating brush. U.S. Pat. No. D401,419 to Hartmann et al. discloses a retractable detail brush with cap.

Accordingly, there is a clearly felt need in the art for an interchangeable retractable hair brush, which includes a retracting brush element that may be interchanged with different brush cases.

SUMMARY OF THE INVENTION

The present invention provides an interchangeable retractable hair brush, which includes an interchangeable retracting brush element and brush case. The interchangeable retractable hair brush includes a retracting brush element and a brush case. The retracting brush element includes a brush base and a brush body. A spring loaded detent pin is retained in the brush base. A notch is preferably formed opposite the spring loaded detent pin, when the brush base and an inside perimeter of the brush case are round. The brush body includes a plurality of brush bristles extending radially from a perimeter thereof. A lift handle is preferably formed on a top of the brush body.

The brush case includes a tubular body and a case base. An inner perimeter of the tubular body is sized to slidably receive an outer perimeter of the brush base. A first location opening is formed through a wall of the brush case to receive the spring detent pin, such that the brush base is resting on the case base. A second location opening is formed through the wall of the brush case, such that the brush body is fully extended from the brush case. When the inner perimeter of the brush case is round, a lengthwise projection extends from the inner perimeter of the brush case. The lengthwise projection is preferably located opposite the first and second location openings. The lengthwise projection extends at least substantially a length of the tubular body and is sized to be received by the notch. The lengthwise projection prevents the brush body from rotating relative to the brush case. The retracting brush element and the brush case preferably come in different styles, shapes and colors for personalization to the aesthetic preferences of the purchaser.

Accordingly, it is an object of the present invention to provide an interchangeable retractable hair brush, which includes a brush element that may be retracted into a brush case.

Finally, it is another object of the present invention to provide an interchangeable retractable hair brush, which includes a retracting brush element that may be interchanged with different styled, shaped or colored brush cases.

These and additional objects, advantages, features and benefits of the present invention will become apparent from the following specification.

BRIEF DESCRIPTION OF THE DRAWINGS

FIG. 1 is a front view of an interchangeable retractable hair brush with a retracting brush element in an extended position in accordance with the present invention.

FIG. 2 is a side cross sectional view of an interchangeable retractable hair brush with the retracting brush element in a retracted position in accordance with the present invention.

FIG. 3 is a top view of an interchangeable retractable hair brush in accordance with the present invention.

DETAILED DESCRIPTION OF THE PREFERRED EMBODIMENTS

Figure 4:
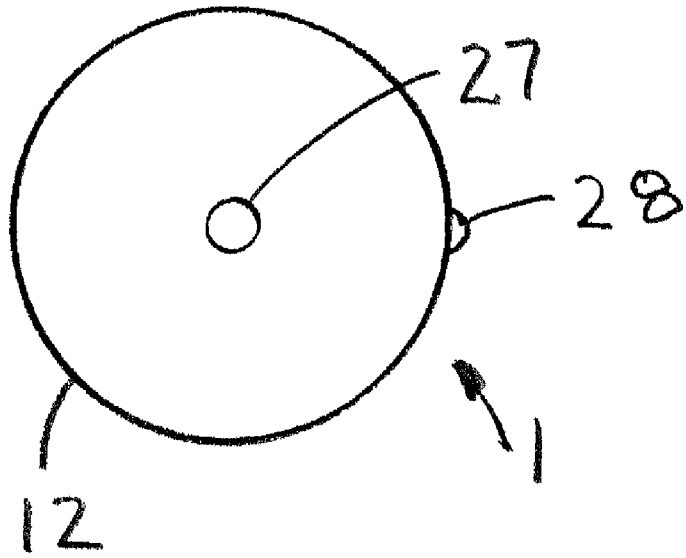
FIG. 4 is a bottom view of an interchangeable retractable hair brush in accordance with the present invention.
Figure 5:
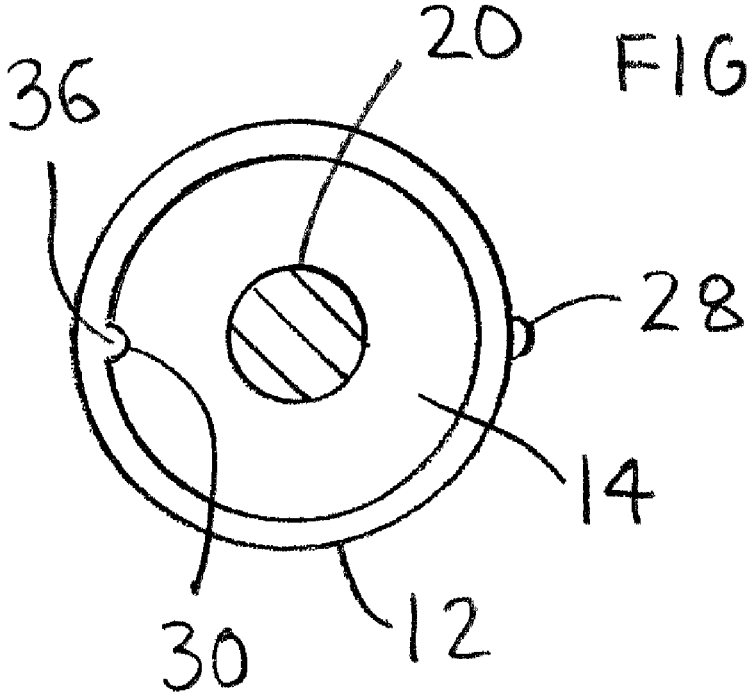
FIG. 5 is a cross sectional view of an interchangeable retractable hair brush cut through FIG. 2 in accordance with the present invention.

With reference now to the drawings, and particularly to FIG. 1, there is shown a front view of an interchangeable retractable hair brush 1 with a retracting brush element 10 in an extended position. With reference to FIGS. 2-5, the interchangeable retractable hair brush 1 includes the retracting brush element 10 and a brush case 12. The retracting brush element 10 preferably includes a brush base 14, a brush body 16 and a lift handle 18. The brush body 16 includes a bristle base 20 and a plurality of brush bristles 22 extending from the bristle base 20. One type of brush is shown, but other styles, shapes and types may also be used. The brush base 14 is formed on one end of the brush body 16 and the lift handle 18 is formed on the other end thereof.

The brush case 12 includes a tubular body 24 and a case base 26. The case base 26 is formed on a bottom of the tubular body 24. An air escape opening 27 is preferably formed through the case base 26 to allow the escape of air due to the sliding fit between an inner perimeter of the brush case 12 and the brush base 14. A spring loaded detent pin 28 is preferably threaded into the brush base 14. Spring loaded detent pins are well known in the art and do not have to be explained in further detail.

A notch 30 is preferably formed opposite the spring loaded detent pin 28, when the brush base 14 and an inside perimeter of the brush case 12 are round. An inner perimeter of the brush case 12 is sized to slidably receive an outer perimeter of the brush base 14. A first location opening 32 is formed through a wall of the brush case 12 to receive the spring detent pin 28, such that the brush base 14 is locked in a retracted position. A second location opening 34 is formed through the wall of the brush case 12, such that the brush body 16 is locked in a fully extended position. The retracting brush element 10 is moved out-of a locked position by pushing the spring detent pin 28 inward and moving the retracting brush element 10 axially, relative to the tubular brush case 12.

When the inner perimeter of the brush case 12 is round, a lengthwise projection 36 extends from the inner perimeter of the brush case 12. The lengthwise projection 36 is preferably located opposite the first and second location openings. The lengthwise projection 36 extends at least substantially a length of the tubular body 24 and is sized to be received by the notch 30. The lengthwise projection 36 prevents the brush body 16 from rotating relative to the brush case 12. The lift handle 18 includes a lift base 38, a pivoting handle 40 and a spring hinge 42. A handle cavity 44 is formed in a top of the lift base 38 to provide clearance for the pivoting handle 40. The spring hinge 42 engages the pivoting handle 40 with the lift base 38, such that the pivoting handle 40 returns to a flat orientation, after use. Spring loaded pivoting handles are well known in the art and do not have to be explained in further detail.

The retracting brush element 10 and the brush case 12 have been shown as having a round cross section. However, the cross section of the brush case 12 may be oval, rectangular or any other suitable shape. The retracting brush element 10 and the brush case 12 preferably come in different styles, shapes and colors for personalization to the aesthetic preferences of the purchaser.

While particular embodiments of the invention have been shown and described, it will be obvious to those skilled in the art that changes and modifications may be made without departing from the invention in its broader aspects, and therefore, the aim in the appended claims is to cover all such changes and modifications as fall within the true spirit and scope of the invention.

I claim:

1. A retracting hair brush comprising:

a tubular brush case;

a retracting brush element including a brush base, a brush body and a plurality of bristles, one end of said brush base extending from one end of said brush body, said plurality of bristles extending radially from around a perimeter surface of said brush body, an inner perimeter of said tubular brush case being sized to slidably receive said brush base, a lift base extends from the other end of said brush base, a handle cavity is formed in said lift base;

a pivoting handle is pivotally retained in said handle cavity; and a spring loaded projection extending from an outer perimeter of said brush base, at least one opening being formed through a wall of said tubular brush body to receive said spring loaded projection, said spring loaded projection locking said retracting brush element in an extended position, wherein said pivoting handle is used to pull said brush body from a retracted position to the extended position.

2. The retracting hair brush of claim 1 wherein:

a lengthwise projection being formed on an inner perimeter of said tubular brush body, a notch being formed in an outer perimeter of said brush base to receive said lengthwise projection.

3. The retracting hair brush of claim 1, further comprising:

a spring hinge pivotally engages said pivoting handle with said lift base, such that said pivoting handle returns to a flat orientation after use.

4. The retracting hair brush of claim 1 wherein:

said retracting brush element and said tubular brush case having different styles, shapes and colors for personalization to the aesthetic preferences of a purchaser.

5. The retracting hair brush of claim 1 wherein:

at least one second opening being formed through said tubular brush case to receive said spring loaded projection for locking the axial location of said retracting brush element relative to said tubular brush case.

6. The retracting hair brush of claim 1 wherein:

a base being formed on a bottom of said tubular brush case.

7. The retracting hair brush of claim 1 wherein:

said tubular body having a round cross section.

8. A retracting hair brush comprising:

a tubular brush case;

a retracting brush element including a brush base, a brush body and a plurality of bristles, said brush base extending from one end of said brush body, said plurality of bristles extending radially from around a perimeter surface of said brush body, an inner perimeter of said tubular brush case being sized to slidably receive said brush base;

a pivoting handle is pivotally engaged with the other end of said brush body with a spring hinge, said spring hinge causes said pivoting handle to return to a flat orientation after use; and a spring loaded projection extending from an outer perimeter of said brush base, at least one opening being formed through a wall of said tubular brush body to receive said spring loaded projection, said spring loaded projection locking said retracting brush element in an extended position, wherein said pivoting handle is used to pull said brush body from a retracted position to the extended position.

9. The retracting hair brush of claim 8 wherein:

a lengthwise projection being formed on an inner perimeter of said tubular brush body, a notch being formed in an outer perimeter of said brush base to receive said lengthwise projection.

10. The retracting hair brush of claim 8, further comprising:

a lift handle extending from the other end of said brush body, a cavity is formed in said lift handle to receive said pivoting handle.

11. The retracting hair brush of claim 8 wherein:

said retracting brush element and said tubular brush case having different styles, shapes and colors for personalization to the aesthetic preferences of a purchaser.

12. The retracting hair brush of claim 8 wherein:

forming at least one second opening through said tubular brush case to receive said spring loaded projection for locking the axial location of said retracting brush element relative to said tubular brush case.

13. The retracting hair brush of claim 8 wherein:

a base being formed on a bottom of said tubular brush case.

14. The retracting hair brush of claim 8 wherein:

said tubular body having a round cross section.

* * * * *